US006805503B1

(12) United States Patent
Tsuchiya et al.

(10) Patent No.: US 6,805,503 B1
(45) Date of Patent: Oct. 19, 2004

(54) WIRE DOT PRINTER HEAD AND WIRE DOT PRINTER

(75) Inventors: Keishi Tsuchiya, Shizuoka (JP); Yasunobu Terao, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/655,282

(22) Filed: Sep. 3, 2003

(51) Int. Cl.[7] ..... B41J 2/275; B41J 2/235

(52) U.S. Cl. ..... 400/124.23; 400/124.12; 101/93.05

(58) Field of Search ..... 400/124.01, 124.11, 400/124.12, 124.23, 124.17; 101/93.04, 93.05

(56) References Cited

U.S. PATENT DOCUMENTS 4,767,227 A * 8/1988 Mitsuishi et al. ..... 400/124.23

6,698,956 B1 * 3/2004 Terao et al. ..... 400/124.23

FOREIGN PATENT DOCUMENTS

| | | | |
|---|---|---|---|
| JP | 3-007351 | * | 1/1991 |
| JP | 6-218954 | * | 8/1994 |
| JP | 2001-219586 A | | 8/2001 |

* cited by examiner

*Primary Examiner*—Leslie J. Evanisko
(74) *Attorney, Agent, or Firm*—Frishauf, Holtz, Goodman & Chick, P.C.

(57) ABSTRACT

A wire dot printer head of the present invention is provided with an abrasion preventive member in a yoke. The abrasion preventive member encloses the outer periphery of the armature support shafts. The yoke, together with an armature spacer having a plurality of cutouts for holding the armature support shafts, holds the armature support shafts. The armature support shafts do not directly contact the yoke because of the use of the abrasion preventive member. It is therefore possible to restrain abrasion of the yoke surface and accordingly to prevent deterioration in printing quality.

14 Claims, 11 Drawing Sheets

WIRE DOT PRINTER HEAD AND WIRE DOT PRINTER

BACKGROUND OF THE INVENTION

1. Field of the Invention

This invention relates to a wire dot printer head and a wire dot printer.

2. Discussion of the Background

A wire dot printer head is an apparatus which performs printing by rocking, between a waiting position and a printing position, an armature with a printing wire connected thereto, to strike the front end of the wire on a printing medium such as a sheet when the armature is rocked to the printing position.

As the wire dot printer head, there has been developed an apparatus for printing by the use of a magnetic circuit which attracts an armature from a waiting position to a printing position with a magnetic flux formed by a coil around the armature to be rocked. As shown in FIGS. 14 and 15, in such a wire dot printer head 100, an armature 102 supporting a printing wire 101 has a support shaft 103. The armature 102 is supported rotatably on the center of the support shaft 103. An armature spacer 105 has a cutout section 104 in which the support shaft 103 of the armature 102 is fitted, and is mounted on a yoke 106 for the formation of the magnetic circuit. On the armature spacer 105, a plate 108 is provided to hold the support shaft 103 which restricts the movement of the armature 102 through an elastic spacer 107 elastically fixing the position of the support shaft 103 of the armature 102. It is possible to thereby prevent abrasion of the plate 108 likely to be caused by the support shaft 103 of the armature 102, and accordingly to fix the position of the support shaft 103.

With recent speedups of printing operation, however, the armature 102 is likely to violently vibrate during printing because of such a high-speed movement between the printing position and the waiting position as 2500 times per second. The support shaft 103, on the center of which the armature 102 rotates, therefore, tends to abrade the surface of the yoke 106. It is generally because the yoke 106 is formed of a softer magnetic material than the support shaft 103 of the armature 102. If the surface abrasion of the yoke 106 proceeds, the support shaft 103 of the armature 102 will move off position, resulting in unstable rocking operation of the armature 102 and accordingly in a deteriorated printing quality.

Furthermore, the support shaft 103 of the armature 102 is moved not only in the rocking direction of the armature 102 but in the radial direction of the armature spacer 105 by vibrations caused by the speedups of the printing operation, resulting in unstable rocking operation of the armature 102. Furthermore, if the surface abrasion of the yoke 106 caused by the support shaft 103 of the armature 102 proceeds, the armature 102 for instance will contact the coil flange and the support shaft 103 will make fine vibrations to rub off stock of the cutout section 104 of the armature spacer 105. Consequently, a shortened life of the wire dot printer head 100 will result.

SUMMARY OF THE INVENTION

It is, therefore, an object of this invention to provide wire dot printer head and wire dot printer which are capable of restraining the abrasion of the yoke surface in order to prevent the deterioration of printing quality.

The object of this invention can be accomplished by novel wire dot printer head and wire dot printer of this invention.

Therefore, according to the novel wire dot printer head and wire dot printer of this invention, there are provided, on a yoke for holding a plurality of armature support shafts, an abrasion preventive member which encloses the outer periphery of the armature support shafts, together with an armature spacer having a plurality of cutout sections in which the armature support shafts for supporting a printing wire are inserted. Thus it is possible to prevent the direct contact of the armature support shafts with the yoke.

BRIEF DESCRIPTION OF THE DRAWINGS

A more complete appreciation of the present invention and any of the attendant advantages thereof will be readily obtained as the same becomes better understood by referring to the following detailed description when considered in connection with the accompanying drawings, wherein.

DETAILED DESCRIPTION OF THE PREFERRED EMBODIMENTS

Wire dot printer head and wire dot printer according to embodiments of this invention will be explained with reference to FIGS. 1 to 13.

Figure 1:
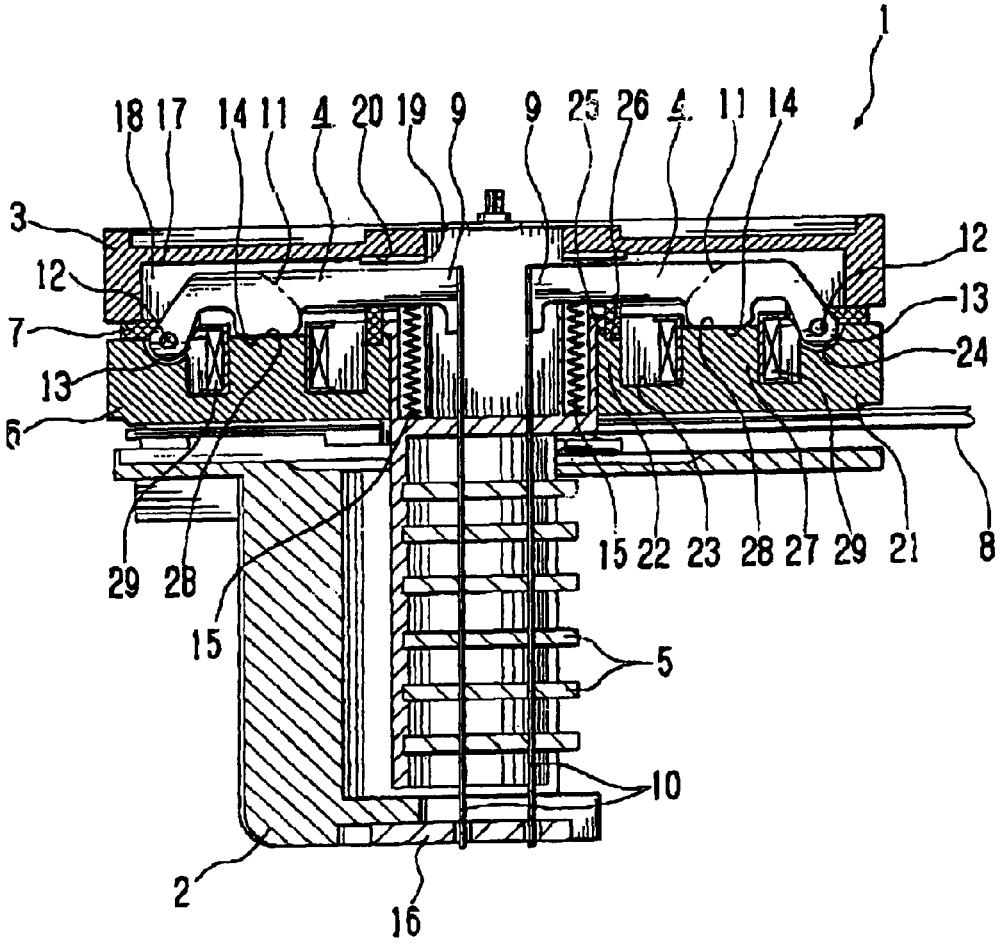
FIG. 1 is a central longitudinal sectional front view schematically showing a wire dot printer head according to an embodiment of this invention.
Figure 2:
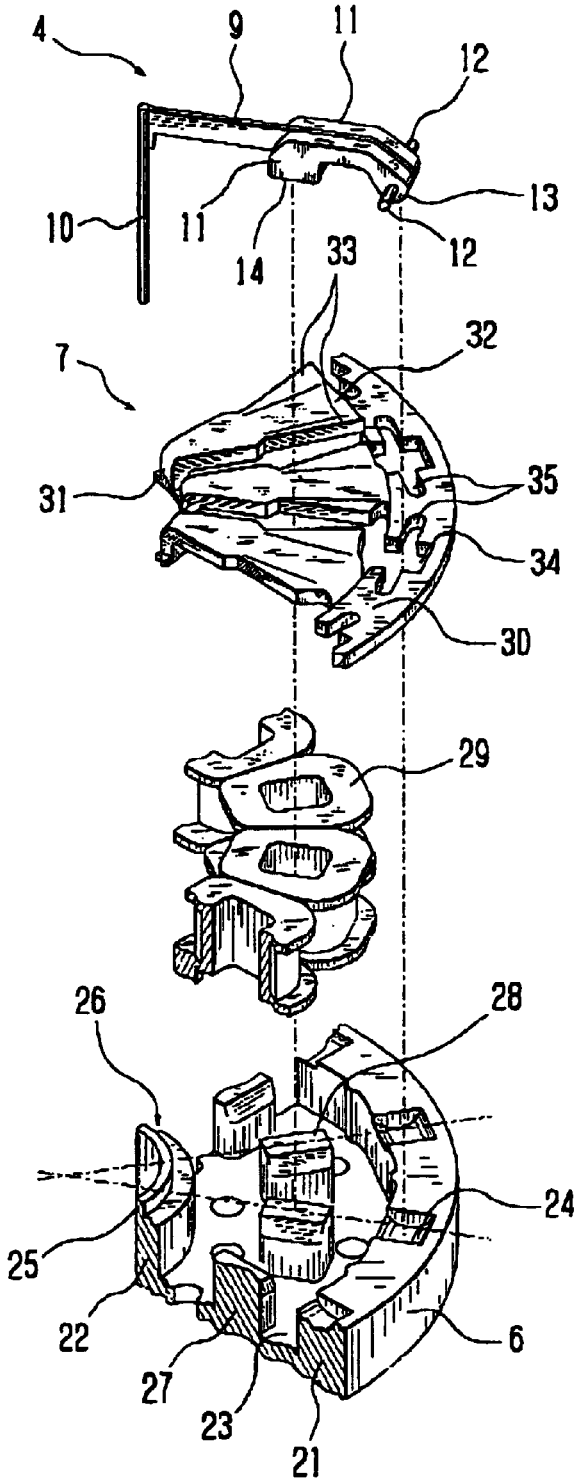
FIG. 2 is an exploded perspective view schematically showing a part of the wire dot printer head according to the embodiment of this invention.
Figure 3:
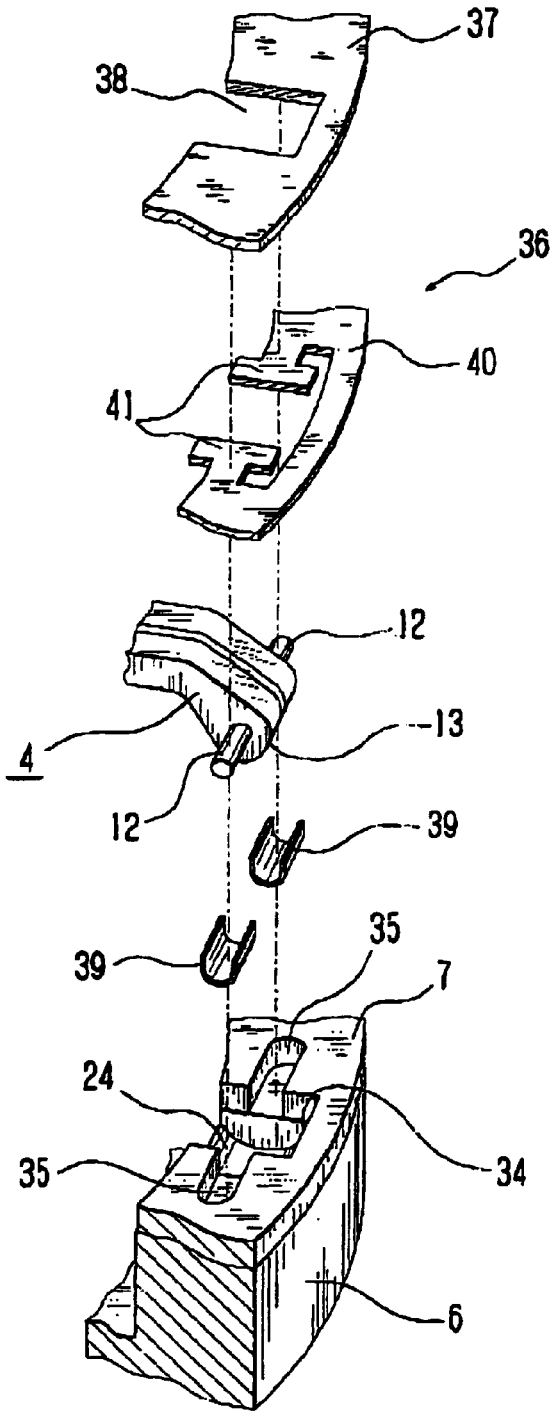
FIG. 3 is an exploded perspective view schematically showing a part of the wire dot printer head according to the embodiment of this invention.
Figure 4:
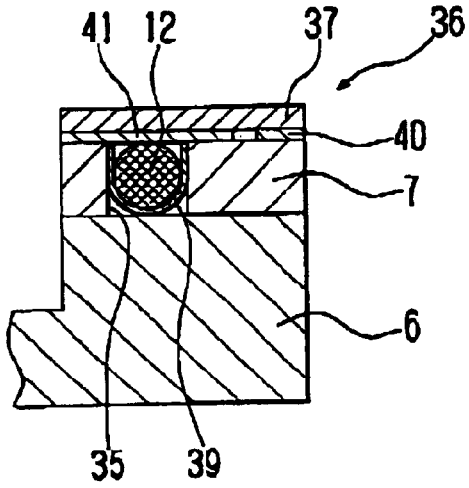
FIG. 4 is a longitudinal sectional side view schematically showing a part of the wire dot printer head according to the embodiment of this invention.

First, the general configuration of the wire dot printer head will be explained. FIG. 1 is a central longitudinal sectional front view schematically showing the wire dot printer head of the present embodiment. FIG. 2 and FIG. 3 are exploded perspective views schematically showing a part of the wire dot printer head. FIG. 4 is a longitudinal sectional side view schematically showing a part of the wire dot printer head.

A wire dot printer head 1 is provided with a front case 2 and a rear case 3 which are connected by mounting screws (not shown). Between the front case 2 and the rear case 3, are located armature 4, wire guide 5, yoke 6, armature spacer 7, and circuit board 8.

The armature 4 is fitted with an arm 9, a printing wire (hereinafter referred to simply as the wire) attached by soldering on one end side in the direction of length of the arm 9, a magnetic circuit forming member 11 attached by welding on both side surfaces in the direction of width of the arm 9, and a support shaft 12. On the other end side of the armature 4, a circular portion 13 is formed. The magnetic circuit forming member 11 has a face to be attracted 14. The face to be attracted 14 is located at the central part in the longitudinal direction of the armature 4.

More than one armature 4 is placed radially in relation to the axis of the yoke 6. The armature 4 is supported on the surface of the yoke 6, rotatable on the center of the support shaft 12 in a direction in which it moves away from the yoke 6. Also, the armature 4 is being pressed by a pressure member in a direction in which it will go away from the yoke 6.

When the armature 4 rocks to the printing position, the front end of the wire 10 moves, with the rocking operation of the armature 4, to a predetermined position, that is, to a position where it strikes on a printing medium such as a sheet.

The wire guide 5 slidably guides the wire 10 so that the front end of the wire 10 will strike in the predetermined position on the printing medium. The front case 2 is provided with a wire end guide 16 for positioning the front end of the wire in a predetermined pattern and also for slidably guiding the wire 10.

The rear case 3 is provided with a cylindrical portion 18 having a bottom section 17 on one end side. At the central part of the bottom section 17, a mounting recess 20 is formed for mounting an annular metallic armature stopper 19. The armature stopper 19 is mounted by being fitted in the mounting recess 20.

When the armature 4 is pressed by the pressure member 15 to rock from the printing position, the arm 9 which is a part of the armature 4 contacts the armature stopper 19, stopping the rocking motion of the armature 4. Therefore, the armature stopper 19 has a function to set the waiting position of the armature 4.

The circuit board 8 has a circuit for controlling the rocking operation of the armature 4 between the printing position and the waiting position. In printing operation, an arbitrary armature 4 can be selectively rocked by controlling the circuit board 8.

The yoke 6 is formed of a magnetic material, having a pair of concentrically formed cylindrical portions 21 and 22 of different diameters. The cylindrical portions 21 and 22 have mutually the same dimensions in the axial direction (in the vertical direction in FIG. 1, which will hereinafter be called the axial direction of the yoke 6). The cylindrical portion 21 on the outer periphery side and the cylindrical portion 22 on the inner periphery side are unitarily formed by a bottom section 23 which is so formed as to close the one-end side in the axial direction.

The cylindrical portion 21 on the outer periphery side is provided with a plurality of recesses 24. The inner periphery of these recesses 24 has a concavity formed to approximately the same curvature as the curvature of the outer periphery of the circular portion 13 of the armature 4. There are provided the same number of the recesses 24 as the armatures 4. In each of the recesses 24, the circular portion 13 is slidably fitted on one-end side of the armature 4.

On the cylindrical portion 22 on the inner periphery side, an annular portion to be fitted 25 is formed. The portion to be fitted 25 is formed integral with the cylindrical portion 22 on the inner periphery side so as to be concentrically positioned in relation to the cylindrical portion 22 on the inner periphery side. The outside diameter of the portion to be fitted 25 is set smaller than the outside diameter of the cylindrical portion 22 on the inner periphery side. Therefore, on the cylindrical portion 22 on the inner periphery side, a stepped portion 26 is formed by the portion to be fitted 25.

The bottom section 23 has a plurality of cores 27 which are formed unitarily in an annular shape between the cylindrical portion 21 on the outer periphery side and the cylindrical portion 22 on the inner periphery side. Each core 27 in the axial direction of the yoke 6 has the same dimensions as the cylindrical portions 21 and 22 in the axial direction of the yoke 6.

On one end in the axial direction of the yoke 6 of each core 27, a pole face 28 is formed. The pole face 28 of the core 27 is provided in such a manner that it will face the face to be attracted 14 of the magnetic circuit forming member 11 of the armature 4. Furthermore, on the outer periphery of each core 27, a coil 29 is wound. That is, the yoke 6 has the cores 27 each wound in an annular form with the coil 29.

The yoke 6 is sandwiched between the front case 2 and the rear case 3 in such a manner that its open side opposite to the bottom section 23 will face to the other open end side of the rear case 3. It should be noted that, in the present embodiment, the direction of winding of all coils 29 is set equal, but is not limited thereto; that is, coils wound in different directions may be selectively positioned.

The armature spacer 7 has a pair of ring-shaped portions and 31 having approximately the same diameter as the cylindrical portions 21 and 22 of the yoke 6, and a plurality of guide portions 32 radially mounted across the pair of ring-shaped portions 30 and 31 so as to be located between the armatures 4. The ring-shaped portion 30 on the outer periphery side and the ring-shaped portion 31 on the inner periphery side are mounted concentrically. The ring-shaped portion 30 on the outer periphery side, the ring-shaped portion 31 on the inner periphery side, and the guide portion 32 are integrally formed.

With the armature spacer 7 placed on the yoke 6, the ring-shaped portion 30 on the outer periphery side and the ring-shaped portion 31 on the inner periphery side contact the cylindrical portions 21 and 22 of the yoke 6. The ring-shaped portion 31 on the inner periphery side, in this position, engages with the portion to be fitted 25. The inside diameter of the ring-shaped portion 31 on the inner periphery side is set equal to, or slightly larger than, the outside diameter of the portion to be fitted 25.

Each guide portion 32 has a side yoke portion 33, which is extended in a slanting direction, that is, in a direction in which the guide portion 32 will go away from the pole face 28 of the core 27 along nearly a radial direction of the ring-shaped portions 30 and 31. The side yoke portion 33 is formed in the shape of a sector which becomes wider as it approaches the ring-shaped portion 30 on the outer periphery side from the ring-shaped portion 31 on the inner periphery side.

In the armature spacer 27, the guide portions 32 are mounted across a pair of ring-shaped portions 30 and 31. There, therefore, are formed slit-like guide grooves 34 which open along the radial direction of the ring-shaped portions 30 and 31. Each of the guide grooves 34 is formed to the width that each guide portion 32 will approach the magnetic circuit forming member 11 to such a degree that the rocking motion of the armature 4 will not be interfered with.

The guide groove 34 communicates with the ring-shaped portion 30 on the outer periphery side. In the guide groove 34 at the ring-shaped portion 30 on the outer periphery side, a bearing groove 35 which is a cutout section is formed, continuously open to the guide groove 34, on both sides of the guide groove 34 along the direction of outside diameter of the ring-shaped portion 30. In the bearing groove 35, the support shaft 12 of the armature 4 is inserted. That is, the support shaft 12 of the armature 4 is held by the yoke 6 and the armature spacer 7 in such a manner that a plurality of armatures 4 may respectively face to the cores 27.

On the armature spacer 7, a holding member 37 is placed to hold the support shafts 12 of the armatures 4 through an abrasion preventive member 36 which encloses the outer periphery of the support shafts 12 of the armatures 4.

The holding member 37 is a member for holding the support shafts 12 of the armatures 4 by connecting the front case 2 and the rear case 3 by mounting screws. The holding member 37 is formed annular. Furthermore, the holding member 37 has a groove portion 38 radially extending in nearly the same width as the width of the armature 4, so that the rocking motion of the armature 4 will not be interfered with.

The abrasion preventive member 36 is comprised of a plurality of protective members 39 located between the support shafts 12 of the armatures 4 and a plurality of bearing grooves of the armature spacer 7, and a pin support plate 40 which is a spacer member located between the support shafts 12 of the armatures 4 and the holding member 37.

The protective member 39 is formed in the shape of a U-cross sectional cylinder, enclosing the support shaft 12 of the armature 4 on three sides. Then, the protective member 39 is fixed by its own elasticity in the bearing groove 35. Furthermore, the protective member 39 is produced of for instance a stainless material of high rigidity and high abrasion resistance.

The pin support plate 40 formed in an annular shape has a plurality of contact portions 41 which contact a plurality of support shafts 12. Furthermore, the pin support plate 40 is so formed as not to interfere with the rocking motion of the armature 4. Here, it will be understood that the pin support plate 40 is formed in the shape of a film, but the invention is not to be limited thereto. Furthermore, the pin support plate is a high abrasion resistance member formed of a polyamide resin for instance.

Figure 5:
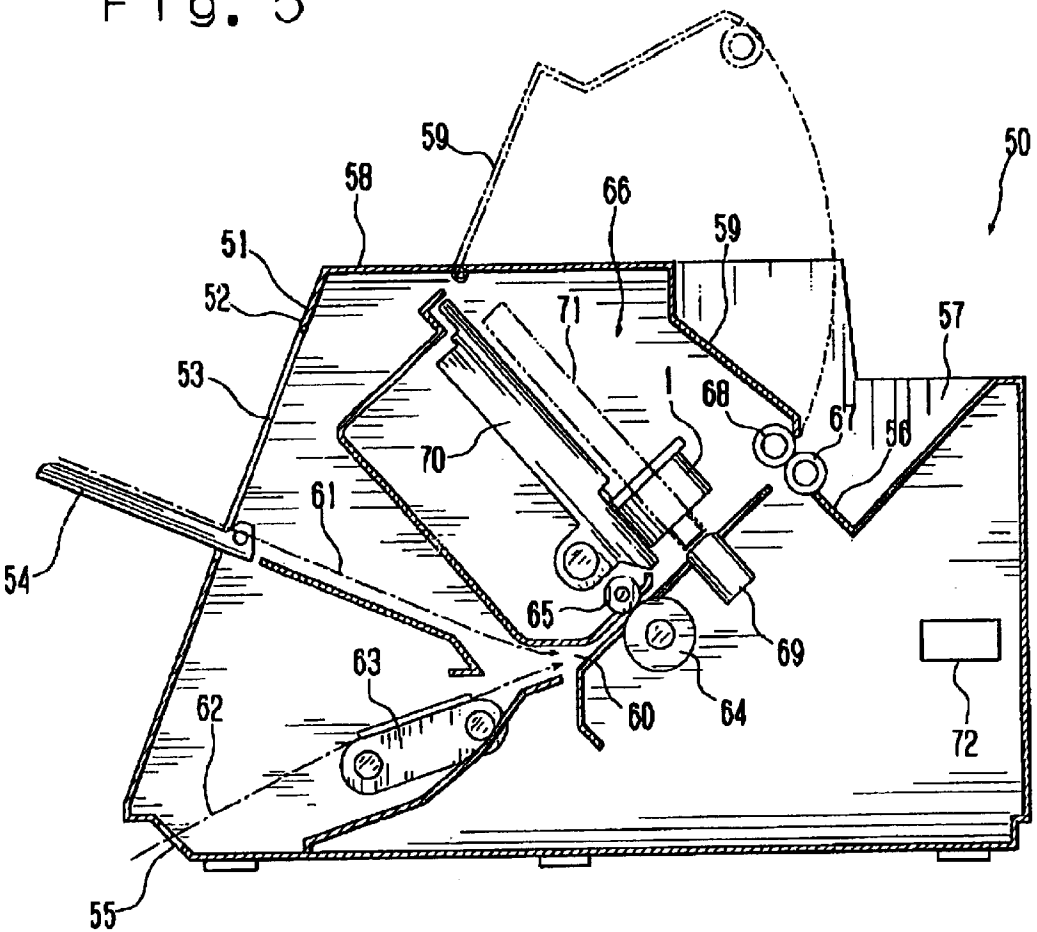
FIG. 5 is a longitudinal sectional side view schematically showing a wire dot printer according to the embodiment of this invention.

Next, a wire dot printer provided with the wire dot printer head 1 previously stated will be described by referring to FIG. 5. FIG. 5 is a longitudinal sectional side view schematically showing the wire dot printer of the present embodiment.

The wire dot printer 50 is provided with a body case 51. At the front 52 of the body case 51, an opening 53 is formed. At the opening 53, a manual feed tray 54 is openably installed. Furthermore, at the lower part on the front 52 side of the body case 51, a paper feed port 55 is formed, while on the back side 56 a printed sheet receiver 57 is installed. Furthermore, at the top 58 of the body case 51, an opening-closing cover 59 is rotatably mounted. The opening-closing cover 59 in its opened position is shown by an imaginary line in FIG. 1.

In the body case 51, there is provided a sheet conveying route 60 which is a printing medium conveying route. The sheet conveying route 60 is connected, on the upstream side in the sheet conveying direction, to a sheet feed passage 61 located on the extension surface of the manual feed tray 54 in the open position and to a sheet feed passage 62 communicating with the paper feed port 55, and, on the downstream side in the sheet conveying direction, to the printed sheet receiver 57. In the sheet feed passage 62, a tractor 63 for carrying the sheet is provided.

In the sheet conveying route 60, a conveyor roller 64 and a press roller 65 are oppositely arranged; the press roller 65 being pressed to the conveyor roller 64. The conveyor roller 64 and the press roller 65, constituting a sheet conveyor section which is a printing medium conveyor section, convey the sheet which is a printing medium. Furthermore, in the sheet conveying route 60, a printer section 66 is provided for printing on a sheet being fed. At the inlet of the printed sheet receiver 57, a sheet discharge roller 67 is provided. A press roller 68 being pressed against the sheet discharge roller 67 is rotatably supported on the free end side of the opening-closing cover 59.

The printer section 66 includes a platen 69 disposed inside of the sheet conveying route 60, a carriage 70 which reciprocably moves along the platen 69 in a direction orthogonal to the sheet conveying route 60, the above-described wire dot printer head 1 mounted on the carriage 70, and an ink ribbon cassette 71. The ink ribbon cassette 71 is removably mounted.

The carriage 70 is driven by power from a motor (not shown), moving reciprocally along the platen 69. With the reciprocation of the carriage 70 along the platen 69, the wire dot printer head 1 reciprocates in the main scanning direction. In the present embodiment, therefore, a head driving mechanism is realized by the carriage 70 and the motor. The wire dot printer 50 has a built-in drive control unit 72 which controls each part in the body case 51. The drive control unit 72 controls the driving of such devices as the printer section 66, the tractor 63, and the motor.

In the wire dot printer of such a configuration as described above, when cut sheets are used as the printing paper, the manual feed tray 54 is used to feed the sheets; and when a continuous paper is used, the paper is fed from the paper feed port 55. In either case, the paper is carried on the conveyor roller 64, and discharged by the sheet discharge roller 67 to the printed sheet receiver 57. In this process, printing is done by the wire dot printer head 1.

Printing is done as follows. In the wire dot printer head 1, when the coil 29 is selectively excited, the armature 4 is attracted to the pole face 28 of the core 27, turning on the center of the support shaft 12 to thereby press the wire 10 against the paper (not shown) on the platen 69 through an ink ribbon (not shown). When the current to the coil 29 is interrupted, the armature 4 is returned by the force of the pressure member 15, stopping in the waiting position at the armature stopper 19.

To describe in detail, in printing by the wire dot printer 50, when the current is supplied selectively to the coil 29 in accordance with printing data by the control of the drive control unit 72, a magnetic circuit is formed from the core 27 fitted with the coil 29 thus selected, through the magnetic circuit forming member 11 of the armature 4 disposed oppositely to the core 27 and a pair of side yoke sections 33 disposed oppositely to the magnetic circuit forming member 11, and through between the cylindrical portion 21 on the outer periphery side and the cylindrical portion 22 on the inner periphery side of the yoke 6, and then from the bottom section 23 back to the core 27.

With the formation of the magnetic circuit, the force of attraction is produced between the face to be attracted 14 of the magnetic circuit forming member 11 and the pole face 28 of the core 27, for attracting the magnetic circuit forming member 11 to the pole face 28 of the core 27. The armature 4, therefore, is rocked on the center of the support shaft 12 in the direction in which the face to be attracted 14 of the magnetic circuit forming member 11 is attracted to the pole face 28 of the core 27. In the present embodiment, the printing position is the position where the face to be attracted 14 of the magnetic circuit forming member 11 of the armature 4 contacts the pole face 28 of the core 27.

With the rocking of the armature 4 to the printing position, the front end of the wire 10 protrudes to the sheet side. In the present embodiment, an ink ribbon (not shown) is interposed between the wire dot printer head 1 and the sheet. Therefore, the pressure of the wire 10 is transmitted to the sheet through the ink ribbon to transfer ink from the ink ribbon to the sheet, thereby performing printing.

When the current to the coil 29 is interrupted, the formation of the magnetic flux will cease, and accordingly the magnetic circuit also will cease. Since the magnetic circuit forming member 11 loses the attraction force for attraction to the pole face 28 of the core 27, the armature 4 is pressed by the pressing member 15 toward a direction moving away from the yoke 6, rocking on the center of the support shaft 12 toward the waiting position. The armature 4 rocks toward the waiting position until the arm 9 contacts the armature stopper 19, thus stopping in the waiting position. Such a printing operation is performed at a high speed.

At this time, the armature 4 rocks between the printing position and the waiting position at a speed of 2500 times per second for example. The support shaft 12 of the armature 4 does not directly contact the yoke 6 and the holding member 37 because of the provision of the abrasion preventive member 36, thereby enabling the prevention of surface abrasion of the yoke 6 and the holding member 37. As a result, it is possible to realize prolongation of the life of the wire dot printer head 1 and to prevent deterioration in printing quality.

In the present embodiment, sheets are used as a printing medium, but are not limited thereto. For example, the pressure-sensitive coloring paper that produces colors on a pressured part may be used. When the pressure-sensitive coloring paper is used as the printing medium, the part thus applied with a pressure by the wire 10 of the wire dot printer head 1 produces colors, thereby performing printing.

Figure 6:
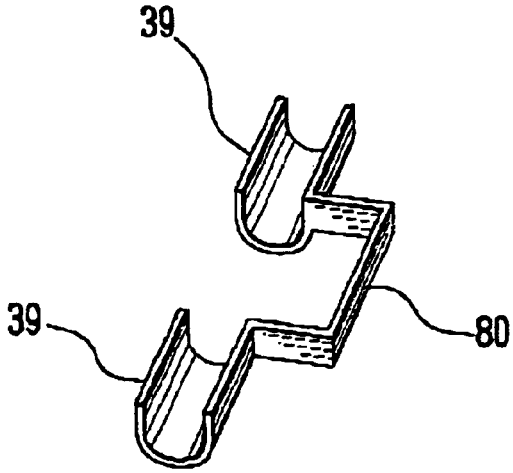
FIG. 6 is a perspective view schematically showing a part of a modification 1 of the wire dot printer head according to the embodiment of this invention.
Figure 7:
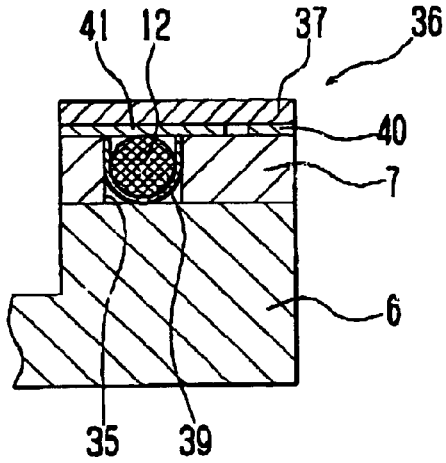
FIG. 7 is a longitudinal sectional side view schematically showing a part of the modification 1 of the wire dot printer head according to the embodiment of this invention.

Next, the modification 1 of the wire dot printer head according to the present embodiment will be described with reference to FIGS. 6 and 7. FIG. 6 is a perspective view schematically showing a part of the modification 1 of the wire dot printer head according to the present embodiment; and FIG. 7 is a longitudinal sectional side view schematically showing a part of the modification 1 of the wire dot printer head according to the present embodiment. It should be noted that the same members as those in the present embodiment are designated by the same reference numerals and will not be described (this will be applied to other modifications described later). The basic structure of the modification 1 of the wire dot printer head is much the same as the wire dot printer head 1 of the present embodiment, and differences thereof will be explained.

The two protective members 39 are uniformly formed as a single member. That is, the two protective members 39 are connected by a connecting portion 80 which is formed to the shape of concavity of the recess 24 of the yoke 6. The connecting portion 80 and the circular upper portion 13 of the armature 4 are so formed as not to interfere with the rocking motion of the armature 4.

Such a modification 1 has the same effect as the present embodiment described above. Furthermore, two protective members 39, being unitarily formed, can easily be installed in the bearing groove 35 as compared with the mounting of the protective members 39 one in each bearing groove 35. According to the modification 1, it is possible to improve operation efficiency and to enhance the position accuracy of the protective members 39.

Figure 8:
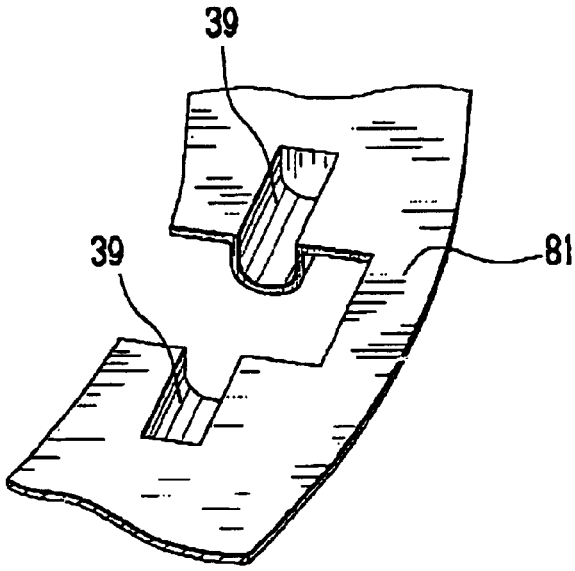
FIG. 8 is a perspective view schematically showing a part of a modification 2 of the wire dot printer head according to the embodiment of this invention.
Figure 9:
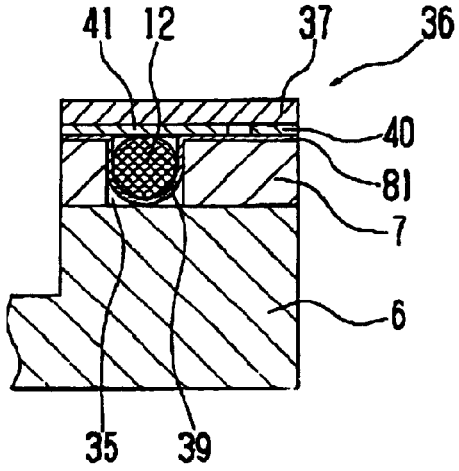
FIG. 9 is a longitudinal sectional side view schematically showing a part of the modification 2 of the wire dot printer head according to the embodiment of this invention.

Next, a modification 2 of the wire dot printer head according to the present embodiment will be explained with reference to FIGS. 8 and 9. FIG. 8 is a perspective view schematically showing a part of the modification 2 of the wire dot printer head according to the present embodiment, and FIG. 9 is a longitudinal sectional side view schematically showing apart of the modification 2 of the wire dot printer head according to the present embodiment. The basic structure of the modification 2 of the wire dot printer head is much the same as the wire dot printer head of the present embodiment described above, and therefore only differences thereof will be explained.

The protective members 39 are protective spacer members 81 all unitarily formed as a single member. The protective spacer member 81 is formed in an annular shape, and furthermore so formed as not to interfere with the rocking motion of the armature 4. The protective spacer member 81 is interposed between the armature spacer 7 and the pin support plate 40. It should be understood that the protective spacer 81 is formed in the shape of film but is not limited thereto. Furthermore, the protective space member 81 is a high abrasion resistance member formed of for instance a polyamide resin.

The modification 2 described above has the same effect as the present embodiment heretofore described. Furthermore, because of the unitary formation of all the protective members 39, the protective member 39 can readily be installed in the bearing groove 35 as compared with mounting the protective members 39 one in each bearing groove 35. It is, therefore, possible to improve operation efficiency and to enhance the position accuracy of the protective member 39.

Figure 11:
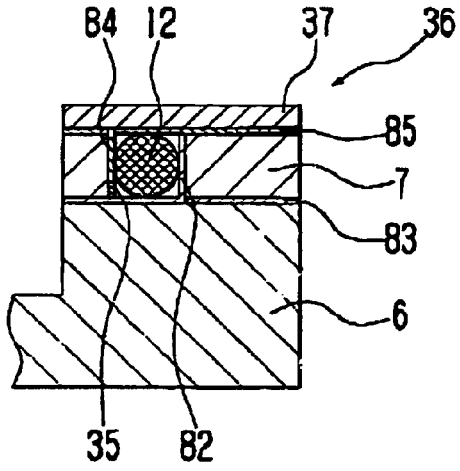
FIG. 11 is a longitudinal sectional side view schematically showing a part of the modification 3 of the wire dot printer head according to the embodiment of this invention.
Figure 10:
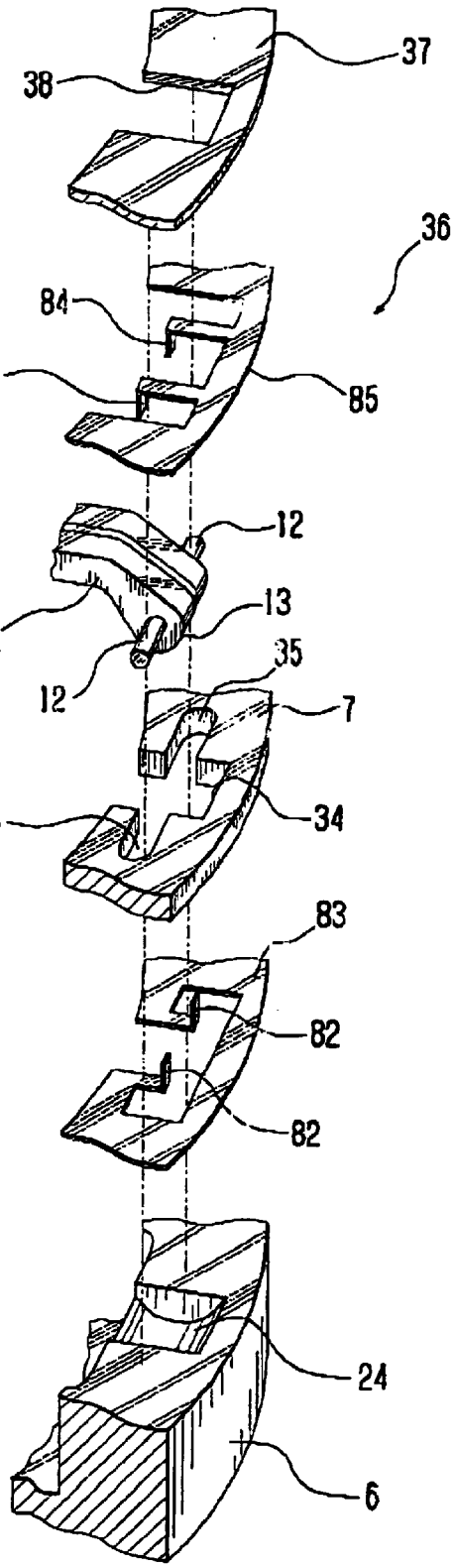
FIG. 10 is an exploded perspective view schematically showing a part of a modification 3 of the wire dot printer head according to the embodiment of this invention.

A modification 3 of a wire dot printer head according to the present embodiment will be described with reference to FIGS. 10 and 11. FIG. 10 is an exploded perspective view schematically showing a part of the modification 3 of the wire dot printer head according to the present embodiment. FIG. 11 is a longitudinal sectional side view schematically showing a part of the modification 3 of the wire dot printer head according to the present embodiment. The basic structure of the modification 3 of the wire dot printer head is much the same as that of the wire dot printer head 1 of the present embodiment, and therefore only differences thereof will be explained.

The abrasion preventive member 36 is comprised of a first bent spacer member 83 having a plurality of first bent portions 82 each extending into the bearing grooves 35 of the armature spacer 7 mounted on the yoke 6, and a second bent spacer member 85 having a plurality of second bent portions 84 each extending into the bearing grooves 35 of the armature spacer 7 oppositely to the first bent portions 82 mounted on the armature spacer 7. The second bent spacer member 85 is mounted in place of the pin support plate 40 shown in FIG. 3.

The first bent spacer member 83 and the second bent spacer member 85 are formed in an annular shape, and furthermore are so formed as not to interfere with the rocking motion of the armature 4. Furthermore, the first bent portion 82 and the second bent portion 84 are formed nearly perpendicularly to the surface of the yoke 6. The outer periphery of the support shaft 12 of the armature 4 is enclosed with the first bent spacer member 83 and the second bent spacer member 85. The first bent spacer member 83 and the second bent spacer member 85 are formed of for instance a stainless material which is a high-abrasion resistance member.

The modification 3 has the same effect as the present embodiment described above. Furthermore, the abrasion preventive member 36, including the first bent spacer member 83 and the second bent spacer member 85, can readily be installed, improving operation efficiency and enhancing position accuracy.

Figure 12:
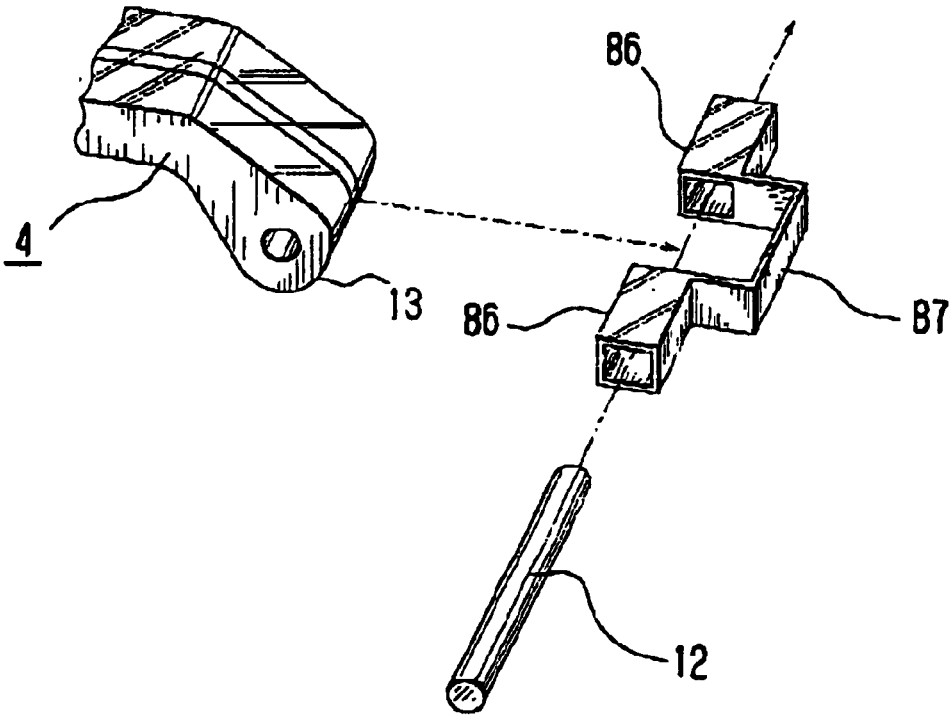
FIG. 12 is a perspective view schematically showing a part of a modification 4 of the wire dot printer head according to the embodiment of this invention.
Figure 13:
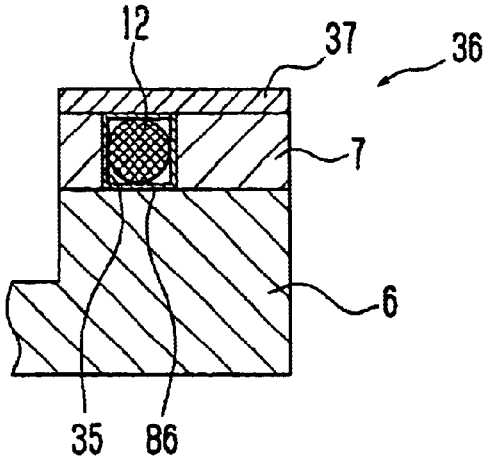
FIG. 13 is a longitudinal sectional side view schematically showing a part of the modification 4 of the wire dot printer head according to the embodiment of this invention.
Figure 15:
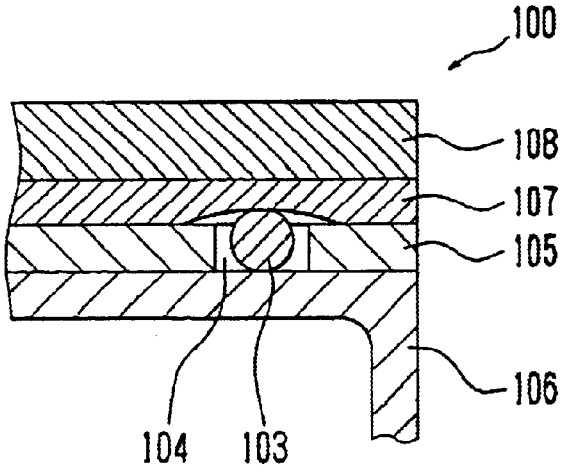
Prior Art Fig. 15
FIG. 15 is a longitudinal sectional side view schematically showing a part of the conventional wire dot printer head.
Figure 14:
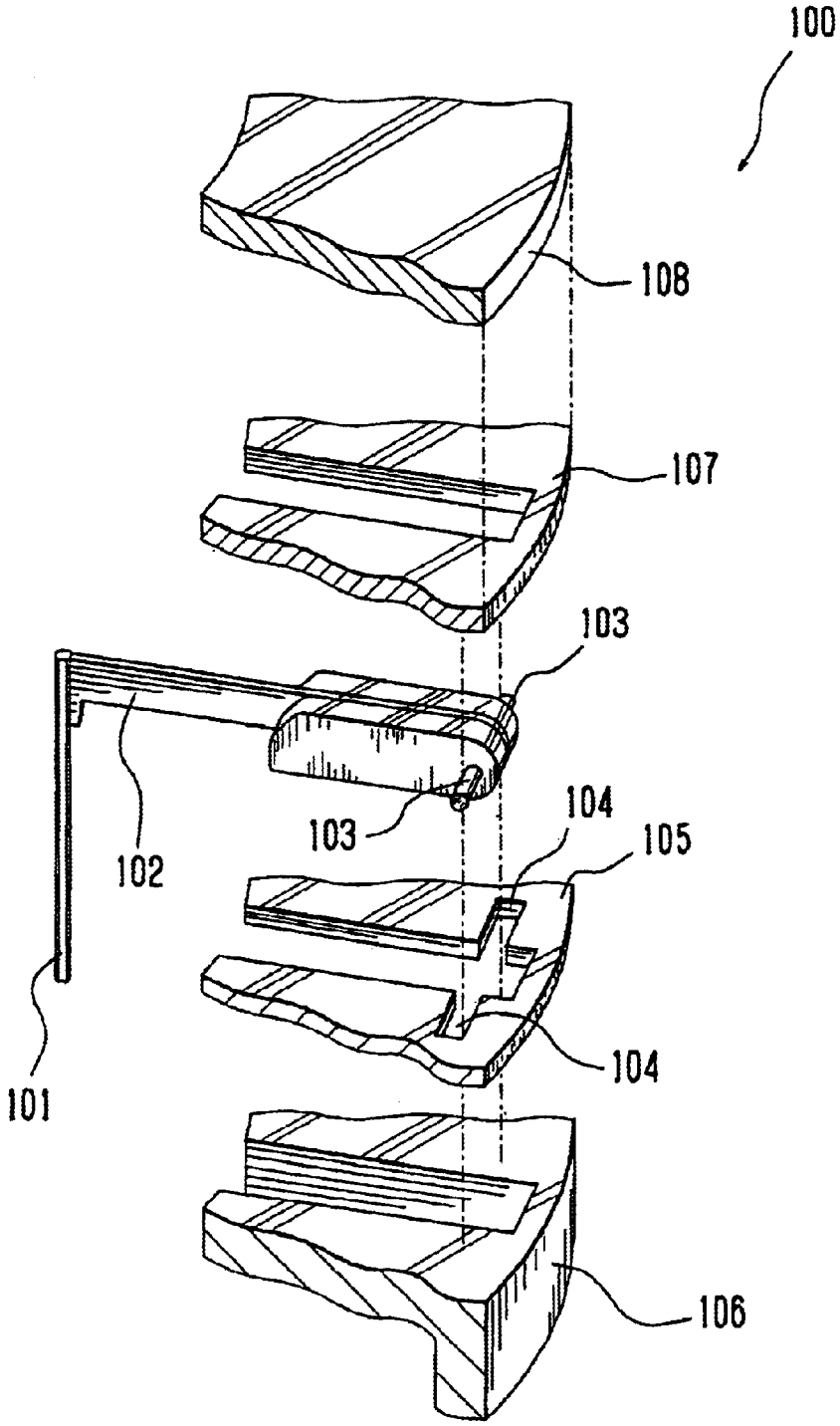
Prior Art Fig. 14
FIG. 14 is an exploded perspective view schematically showing a part of a conventional wire dot printer head.

A modification 4 of the wire dot printer head according to the present embodiment will be explained with reference to FIGS. 12 and 13. FIG. 12 is a perspective view schematically showing a part of the modification 4 of the wire dot printer head according to the present embodiment. FIG. 13 is a longitudinal sectional side view schematically showing a part of the modification 4 of the wire dot printer head according to the present embodiment. The basic structure of the modification 4 of the wire dot printer head is much the same as the wire dot printer head 1 of the present embodiment described above, and therefore only differences thereof will be explained.

The abrasion preventive member 36 is composed of a plurality of enclosing members 86 each enclosing the outer periphery of the support shafts 12 of the armatures 4. The two enclosing members 86 are unitarily formed as one member. That is, the two enclosing members 86 are connected by a connecting part 87 formed to the shape of concavity of the recess 24, being formed in one body. The connecting portion 87 and the circular upper part 13 of the armature 4 are so formed as not to interfere with the rocking motion of the armature 4.

The enclosing member 86 and the connecting portion 87 is a high-rigidity, high-abrasion resistance member formed of for instance a stainless material. Here, the outer periphery of the support shaft 12 of the armature 4 is enclosed with the enclosing member 86, and therefore the pin support plate 40 as shown in FIG. 3 is not needed.

The modification 4 has the same effect as the present embodiment described above. Furthermore, since the two enclosing members 86 are unitarily formed, the enclosing members 86 can easily be installed in the bearing grooves 35 as compared with the mounting of the enclosing members 86 one in each bearing groove 35, thereby improving operation efficiency and enhancing the position accuracy of the enclosing members 86.

Obviously, numerous modifications and variations of the present invention are possible in light of the above teachings. It is therefore to be understood that within the scope of the appended claims, the invention may be practiced otherwise than as specifically described herein.

What is claimed is:

1. A wire dot printer head comprising:

a plurality of armatures each supporting a printing wire, and each having a support shaft on the center of which the armature rotates;

a yoke having a plurality of cores each wound with a coil, and supporting each support shaft of the armatures in such a manner that the armatures may face to a plurality of cores respectively;

an armature spacer mounted on the yoke, having a plurality of cutouts in which the plurality of support shafts are held in such a manner that the armatures can rock therein, and holding, together with the yoke, the armature support shafts;

a holding member mounted on the armature spacer, and so formed as not to interfere with the rocking motion of the armatures, for holding the armature support shafts; and an abrasion preventive member enclosing the outer periphery of the armature support shafts.

2. A wire dot printer head according to claim 1, wherein the abrasion preventive member comprises a plurality of protection members mounted between the armature support shafts and the cutouts of the armature spacers; and a spacer member interposed between the armature support shafts and the holding member, and so formed as not to interfere with the rocking motion of the armatures.

3. A wire dot printer head according to claim 2, wherein the two protective members are unitarily formed as a single member.

4. A wire dot printer head according to claim 2, wherein the protective members are protective spacer members all unitarily formed as a single member, and the protective spacer members are interposed between the armature spacers and the spacer members.

5. A wire dot printer head according to claim 1, wherein the abrasion preventive member comprises a first bent spacer member mounted on the yoke, and having a plurality of first bent portions extending into a plurality of cutouts of the armature spacers; and a second bent spacer member mounted on the armature spacers, and having a plurality of second bent portions extending into the cutouts of the armature spacers, respectively facing to the first bent portions.

6. A wire dot printer head according to claim 1, wherein the abrasion preventive member comprises a plurality of enclosing members which enclose the outer periphery of the armature support shafts.

7. A wire dot printer head according to claim 6, wherein the two enclosing members are unitarily formed as a single member.

8. A wire dot printer comprising:

a wire dot printer head according to claim 1;

a platen located oppositely to the wire dot printer head;

a carriage which holds the wire dot printer head, reciprocating along the platen;

a printing medium convey or section which conveys a printing medium between the wire dot printer head and the platen; and a drive control unit which drives the wire dot printer head, the carriage, and the printing medium conveyor section in accordance with printing data.

9. A wire dot printer comprising:

a wire dot printer head according to claim 2;

a platen located oppositely to the wire dot printer head;

a carriage which holds the wire dot printer head, reciprocating along the platen;

a printing medium convey or section which conveys a printing medium between the wire dot printer head and the platen; and a drive control unit which drives the wire dot printer head, the carriage, and the printing medium conveyor section in accordance with printing data.

10. A wire dot printer comprising:

a wire dot printer head according to claim 3;

a platen located oppositely to the wire dot printer head;

a carriage which holds the wire dot printer head, reciprocating along the platen;

a printing medium convey or section which conveys a printing medium between the wire dot printer head and the platen; and a drive control unit which drives the wire dot printer head, the carriage, and the printing medium conveyor section in accordance with printing data.

11. A wire dot printer comprising:

a wire dot printer head according to claim 4;

a platen located oppositely to the wire dot printer head;

a carriage which holds the wire dot printer head, reciprocating along the platen;

a printing medium conveyor section which conveys a printing medium between the wire dot printer head and the platen; and a drive control unit which drives the wire dot printer head, the carriage, and the printing medium conveyor section in accordance with printing data.

12. A wire dot printer comprising:

a wire dot printer head according to claim 5;

a platen located oppositely to the wire dot printer head;

a carriage which holds the wire dot printer head, reciprocating along the platen;

a printing medium conveyor section which conveys a printing medium between the wire dot printer head and the platen; and a drive control unit which drives the wire dot printer head, the carriage, and the printing medium conveyor section in accordance with printing data.

13. A wire dot printer comprising:

a wire dot printer head according to claim 6;

a platen located oppositely to the wire dot printer head;

a carriage which holds the wire dot printer head, reciprocating along the platen;

a printing medium conveyor section which conveys a printing medium between the wire dot printer head and the platen; and a drive control unit which drives the wire dot printer head, the carriage, and the printing medium conveyor section in accordance with printing data.

14. A wire dot printer comprising:

a wire dot printer head according to claim 7;

a platen located oppositely to the wire dot printer head;

a carriage which holds the wire dot printer head, reciprocating along the platen;

a printing medium conveyor section which conveys a printing medium between the wire dot printer head and the platen; and a drive control unit which drives the wire dot printer head, the carriage, and the printing medium conveyor section in accordance with printing data.

* * * * *